United States Patent [19]

Karlen

[11] 4,140,252

[45] Feb. 20, 1979

[54] DECANTER HAVING SET-IN-PLACE SEALING MEANS

[75] Inventor: Harvey R. Karlen, Chicago, Ill.

[73] Assignee: Cory Food Services, Inc., Chicago, Ill.

[21] Appl. No.: 807,813

[22] Filed: Jun. 20, 1977

Related U.S. Application Data

[63] Continuation of Ser. No. 727,256, Sep. 27, 1976, abandoned, and a continuation of Ser. No. 602,761, Aug. 7, 1975, abandoned.

[51] Int. Cl.[2] ..... A47G 19/14

[52] U.S. Cl. ..... 222/465; 215/100 A; 222/542

[58] Field of Search ..... 222/465, 542, 475; 215/100 R, 100 A, DIG. 6, 352; 220/85 R, 85 SP, 378

[56] References Cited

U.S. PATENT DOCUMENTS

| | | | |
|---|---|---|---|
| 845,777 | 3/1907 | Grossman | 215/100 R |
| 2,243,164 | 5/1941 | Maddock | 220/85 K |
| 2,376,909 | 5/1945 | Ford | 215/352 X |
| 2,920,778 | 1/1960 | Foye | 215/352 |
| 3,331,521 | 7/1967 | Paige | 215/DIG. 6 |
| 3,800,988 | 4/1974 | Karlen et al. | 222/465 |
| 3,825,142 | 7/1974 | Campagna | 215/DIG. 6 |

*Primary Examiner*—Stanley H. Tollberg
*Assistant Examiner*—Francis J. Bartuska
*Attorney, Agent, or Firm*—Wegner, Stellman, McCord, Wiles & Wood

[57] ABSTRACT

A decanter structure wherein a glass liquid-holding bowl is provided with an upstanding neck. An annular set-in-place seal is provided about the neck effectively permanently bonded to the neck and removably sealingly engaging a one-piece handle and spout element connected to the neck. A protective bumper band is set-in-place about the portion of the globular bowl of largest diameter to define a resilient bumper permanently bonded to the glass bowl.

6 Claims, 2 Drawing Figures

DECANTER HAVING SET-IN-PLACE SEALING MEANS

CROSS-REFERENCE TO RELATED APPLICATIONS

This application comprises a continuation of my copending application Ser. No. 727,256, filed Sept. 27, 1976, entitled "Decanter Having Set-In-Place Sealing Means," now abandoned, and comprising a continuation of my application Ser. No. 602,761, filed Aug. 7, 1975, entitled "Decanter Having Set-In-Place Sealing and Bumper Means," now abandoned.

BACKGROUND OF THE INVENTION

1. Field of the Invention

This invention relates to decanters and in particular to glass decanters adapted for serving liquids, such as hot coffee.

2. Description of the Prior Art

In U.S. Pat. No. 3,717,288 of Norman H. Schlegel, owned by the assignee hereof, a decanter handle structure is disclosed having a handle connected to the neck of the decanter by a split collar and a protective band extending about the globular portion of the decanter bowl. The handle structure comprises a one-piece device formed of suitable molded plastic.

In U.S. Pat. No. 3,800,988 of Harvey R. Karlen et al, owned by the assignee hereof, a one-piece spout and handle structure is shown wherein the handle is secured to the neck of the decanter by an annular connector portion having an integral spout portion extending outwardly from the top of the neck. The connecting portion is sealed to the glass neck by an O-ring and the handle structure is secured to the glass decanter bowl by an inturned rib drawn into an annular recess on the decanter neck by suitable threaded or riveted means.

A multiple element handle and pouring spout assembly is shown in U.S. Pat. No. 3,114,484 of Anthony W. Serio. In the Serio assembly, a rubber seal is compressed within the attaching portion of the handle assembly to seal the assembly to the glass decanter neck.

Daniel L. Killigrew, Jr., in U.S. Pat. No. 3,688,936, shows a decanter assembly wherein the glass bowl is provided with a peripheral groove receiving a resilient band attached to the lower portion of the handle.

William R. Mahnken, in U.S. Pat. No. 1,446,474, shows a bottle appliance wherein means for closing the top of the bottle are mounted to the handle which is connected to the bottle by a pair of connecting bands.

In U.S. Pat. No. 3,049,219 of John J. Muschinske et al, a bottle attachment is shown wherein a spout portion formed of plastic or deformable material is stretched over the rim of the bottle. The handle comprises a wire means which includes a ring clamped about the spout to rigidly secure the handle and spout to the bottle.

SUMMARY OF THE INVENTION

The present invention comprehends an improved decanter structure having a glass bowl provided with an upstanding tubular neck, a pouring spout, annular means for mounting the pouring spout on the neck, a handle connected to the neck, and means defining an annular set-in-place seal extending about the neck, the seal being formed of an adhesive material preselected to be effectively permanently bonded to the neck as a result of setting thereof in place on the neck, the annular mounting means extending about the set annular seal in removable sealed engagement therewith.

The outer surface of the seal may be substantially semicircular in cross section.

The mounting means may forcibly urge the seal axially toward the bowl, with the strength of the bond between the seal and the neck being preselected to preclude axial displacement of the seal.

The seal is formed to have an outer uncompressed diameter greater than the inner diameter of the mounting means.

The invention further comprehends the provision of an annular set-in-place band on the globular portion of the decanter bowl of maximum diameter. The annular band may be formed of the same material as the seal and defines a resilient bumper bonded to the glass bowl for protecting the bowl in normal use thereof.

The seal and band material may comprise settable adhesive material which, when set, provides resilient characteristics suitable for the sealing and protective functions discussed above.

The band may have a semicircular cross-sectional outer surface and may have a thickness similar to the width thereof.

In the illustrated embodiment, the width of the band is less than approximately ¼" while yet providing the highly desirable bowl protecting functioning discussed above.

Thus, the decanter structure of the present invention is extremely simple and economical of construction while yet providing the highly desirable features discussed above.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
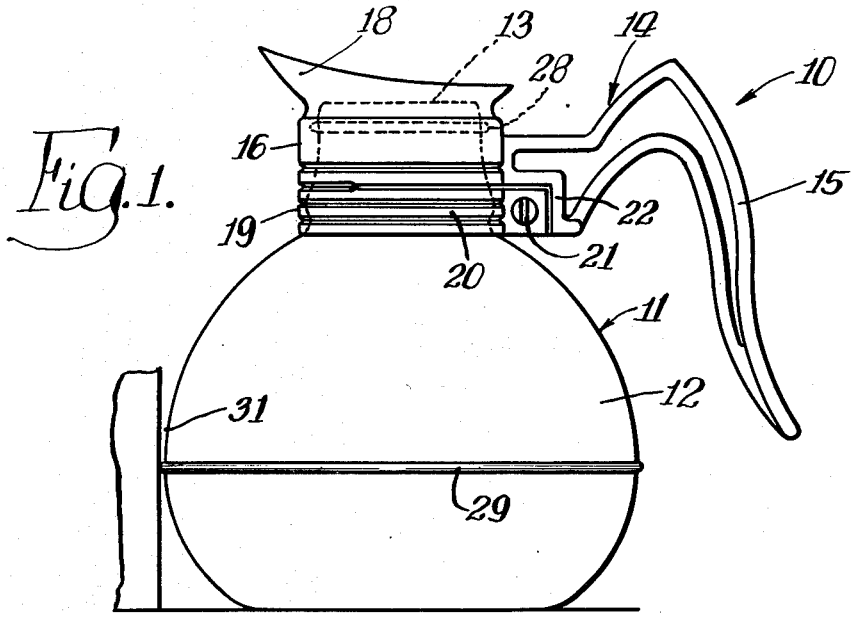
FIG. 1 is a side elevation of a decanter structure embodying the invention.

In the exemplary embodiment of the invention as disclosed in the drawing, a decanter structure generally designated 10 includes a glass bowl generally designated 11 defined by a lower globular liquid-holding portion 12 and an upper, generally tubular pouring neck portion 13.

A one-piece handle structure generally designated 14 is connected to the decanter neck 13 for manipulating the decanter in the normal use thereof.

The handle structure includes a grasping handle 15 connected to an annular mounting portion 16 adapted to encircle the upper end 17 of decanter neck 13.

Integral with connecting portion 16 is a pouring spout portion 18 flaring outwardly from the upper end of the connecting portion to define means for pouring liquid from the decanter.

Figure 2:
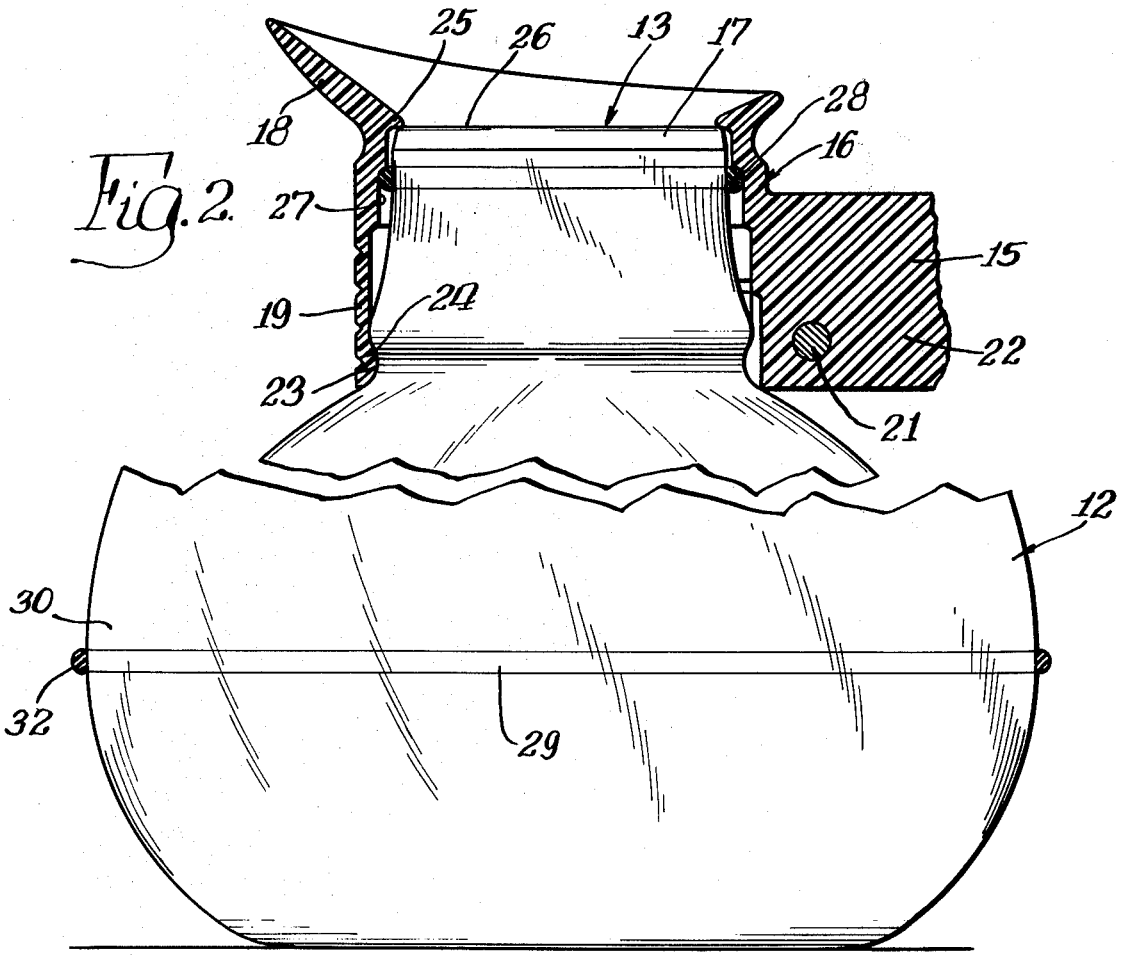
FIG. 2 is a fragmentary enlarged vertical section thereof.

Also integral with mounting portion 16 is a lower clamp portion 19 having a split annular rear section 20. Section 20 is locked about the lower end of neck 13 by a screw 21 extending therethrough into an integral portion 22 of handle 15. The decanter neck defines an annular recess 23 adapted to receive an inturned annular end portion 24 at the lower end of clamp portion 19, as shown in FIG. 2, thereby locking the handle structure 14 to the decanter. In the installed locked position, an inturned flange 25 at the upper end of mounting portion 16 seats on the distal end 26 of neck portion 17.

The mounting portion 16 further defines an annular sealing surface 27 spaced below flange 25. The invention comprehends providing an improved seal 28 about neck portion 17 to have removable sealed engagement with sealing surface 27 when the handle structure 14 is installed on the decanter neck.

More specifically, seal 28 comprises an annular set-in-place seal extending fully about neck portion 17. The seal is preferably formed of an adhesive material preselected to be effectively permanently bonded to the neck as a result of setting thereof in place on the neck. The seal material is preferably resilient in the set condition and is formed on the neck to have an uncompressed outer diameter slightly greater than the diameter of sealing surface 27. Thus, as seen in FIG. 2, an interference fit is provided between the seal and sealing surface which, during the installation of the handle structure on the decanter neck, tends to urge the seal axially downwardly on the neck. The seal material is preselected to have a bonding strength sufficient to prevent displacement of the seal downwardly on the neck during such installation and effectively provides for a permanent bonding of the seal to the glass neck.

The present invention provides a substantial improvement in the manufacture of such glass decanters in that the manufacture of such glass articles requires a relatively high tolerance, such as in the outer diameter dimensions of the neck. It has been found that the conventional rubber O-ring has limited application in such structures because of relatively large diameter variations conventionally found in the glass decanter art which may be in the range of ±0.045" for such decanter necks. The forming-in-place of the seal effectively eliminates the problem relative to the mounting of the seal on the decanter neck relative to the tolerance in the neck diameter within the conventional relatively wide range.

The invention further comprehends providing an improved protective band 29 about the portion 30 of bowl 12 of largest diameter for protecting the bowl against chipping and the like by engagement with adjacent surfaces, such as surfaces 31 illustrated in FIG. 1. The protective band herein is formed in a manner similar to the formation of seal 28 in comprising an annular set-in-place band formed of an adhesive material preselected to be effectively permanently bonded to the decanter bowl as the result of the setting thereof in place on the bowl portion.

The band is resilient and, thus, defines an improved protective bumper surrounding the bowl and protecting it against chipping and the like as by contact of the bowl with potentially chipping surfaces, such as surface 31.

Band 29 has a cross section similar to that of seal 28 in being defined by an outer semicircular surface 32. The width of the band (i.e. parallel to the underlying glass surface) may be greater than the thickness thereof (i.e. perpendicular to the glass surface), as shown in FIG. 2, and in the illustrated embodiment, the band has a cross-sectional width less than approximately ¼" while yet providing an effective protective encirclement of the bowl portion 30 preventing undesirable chipping of the bowl in normal use.

In one improved form of the invention, each of the seal 28 and band 29 were formed of an RTV silicone adhesive. As will be obvious to those skilled in the art, other suitable materials having the desired bonding and resilient characteristics adapted to be set in place on the glass neck and bowl portions of the decanter may be utilized within the scope of the invention.

The seal and band structures are extremely simple and economical of construction while yet providing the improved sealing and bowl protective functioning as discussed above. The seal and band may be applied to the decanter concurrently if desired. The seal and band, being effectively permanently bonded to the glass, provide a long, trouble-free life in the sealing of the handle structure to the neck and the protection of the glass bowl against undesirable chipping and breakage.

The foregoing disclosure of specific embodiments is illustrative of the broad inventive concepts comprehended by the invention.

I claim:

1. In a decanter structure having a glass bowl provided with an upstanding tubular neck, a pouring spout, annular means for mounting said pouring spout on said neck having an inturned flange abutting the upper end of said neck, means for interlocking the pouring spout removably to the neck, and a handle connected to said spout, the improvement comprising:

means on said annular means defining an axially downwardly facing, radially inwardly extending annular shoulder; and means defining an annular set-in-place resilient seal extending about said neck, said seal being formed of an adhesive marterial preselected to be effectively permanently sealingly bonded to said neck as a result of setting thereof in place on said neck, the strength of the bond being preselected to retain the seal against downward displacement as a result of said annular mounting means being removably installed about the set annular seal by downward axial movement thereabout causing an urging of the seal axially downwardly by said shoulder, said mounting means and neck cooperatively defining an annular space therebetween which has a radial dimension for a substantial distance downwardly from said seal substantially equal to the radial dimension thereof at said seal, said downward urged seal being maintained in deformed, axially and radially compressed sealed engagement with said mounting means by said shoulder means as a result of said interlocking means maintaining said mounting means in said downwardly installed disposition.

2. The decanter structure of claim 1 wherein the outer surface of the undeformed seal is substantially semicircular in cross section.

3. The decanter structure of claim 1 wherein said seal is resilient and formed to have an outer uncompressed diameter prior to installation of the mounting means greater than the inner diameter of the portion of the mounting means engaging said seal as a result of the installation of the mounting means.

4. The decanter structure of claim 1 wherein said seal is formed of RTV silicone adhesive.

5. In a decanter structure having a glass bowl provided with an upstanding tubular neck, a pouring spout, annular means for mounting said pouring spout on said neck having an inturned flange abutting the upper end of said neck, means for interlocking the pouring spout removably to the neck, and a handle connected to said spout, the improvement comprising:

means on said annular means defining an axially downwardly facing, radially inwardly extending annular shoulder;

means defining an annular set-in-place resilient seal extending about said neck, said seal being formed of an adhesive material preselected to be effectively permanently sealingly bonded to said neck as a result of setting thereof in place on said neck, the strength of the bond being preselected to retain the seal against downward displacement as a result of said annular mounting means being removably installed about the set annular seal by downward axial movement thereabout causing an urging of the seal axially downwardly by said shoulder, said mounting means and neck cooperatively defining an annular space therebetween which has a radial dimension for a substantial distance downwardly from said seal substantially equal to the radial dimension thereof at said seal, said downwardly urged seal being maintained in deformed axially and radially compressed sealed engagement with said mounting means by said shoulder means as a result of said interlocking means maintaining said mounting means in said downwardly installed disposition; and a protective set-in-place band extending about said bowl, the outer surface of said band being substantially semicircular in cross section.

6. The decanter structure of claim 5 wherein said band is formed of RTV silicone adhesive.

* * * * *